United States Patent [19]

Anscher

[11] Patent Number: 4,949,436

[45] Date of Patent: Aug. 21, 1990

[54] PRESS RELEASE FASTENER

[76] Inventor: Joseph A. Anscher, 7 Marlin La., Port Washington, N.Y. 11743

[21] Appl. No.: 231,149

[22] Filed: Aug. 11, 1988

[51] Int. Cl.[5] ..... A44B 11/25

[52] U.S. Cl. ..... 24/671; 24/633; 24/616

[58] Field of Search ..... 24/616, 615, 671, 633, 24/637, 635, 588, 597

[56] References Cited

U.S. PATENT DOCUMENTS

| | | | |
|---|---|---|---|
| 3,251,110 | 5/1966 | Hedu | 24/616 |
| 3,798,711 | 3/1974 | Cousins | 24/616 |
| 3,967,351 | 7/1976 | Rosenberg et al. | 24/616 |
| 4,035,877 | 7/1977 | Brownson et al. | 24/633 |
| 4,150,464 | 4/1979 | Tracy | 24/615 |
| 4,398,324 | 8/1983 | Bakker et al. | 24/615 |
| 4,425,689 | 1/1984 | Fildan | 24/616 |
| 4,688,337 | 8/1987 | Dillner et al. | 24/616 |

*Primary Examiner*—Victor N. Sakran
*Attorney, Agent, or Firm*—Kenyon & Kenyon

[57] ABSTRACT

A two piece flat, low-profile separable fastener comprising a clasp and a receptacle, the clasp comprising a base and a rigid tongue having a release tab with a first shoulder that is a first stop means protruding therefrom; the receptacle comprising a body that defines a cavity and an aperture on an upper surface of said receptacle, the aperture having a second shoulder that is a second stop means disposed for cooperative engagement with said first stop means, means for urging said release tab into said aperture such that said first and second stop means abut one another and said receptacle and clasp are engaged, and means for releasing the engagement so that the receptacle and clasp may be separated. In a preferred embodiment of the present invention the fastener is in the form of a buckle and the means for urging the first and second stop means into abutment are located in the receptacle portion of the buckle.

22 Claims, 3 Drawing Sheets

PRESS RELEASE FASTENER

BACKGROUND OF THE INVENTION

This invention relates generally to a buckle-type fastener, and more particularly to a fastener made up of two separable pieces.

Two piece buckle-type fasteners are incorporated into leisure, camping, sports, and safety products. Typically they are employed to fasten together the two ends of a belt, for example in a backpack or a life jacket.

U.S. Pat. No. 4,150,464, issued to Tracy, discloses a separable buckle wherein two parallel resilient arms of the clasp piece are each provided with a tab that locks into a corresponding slot in a receptacle piece. A central rigid arm is provided with stop means that limit the bending of the resilient arms.

U.S. Pat. No. 3,798,711, issued to Cousins, discloses a separable buckle wherein the frame portion of the male piece has an obliquely disposed resilient tongue that terminates to define a shoulder facing the free end portion of the male piece. To fasten the buckle, the frame portion of the male piece is positioned within the housing, and the shoulder of the tongue engages a bar in the housing that defines a fenestration therein.

U.S. Pat. No. 4,688,337, issued to Dillner et al. commonly assigned with the present invention, discloses a separable buckle wherein the male piece has the locking element that locks into a corresponding slot in the receptacle piece. The male piece is also designed to allow proper insertion at various angles and release upon applying pressure to tabs located on the side of the device. The male piece also has resilient arms extending from its distal end with tabs that lockingly engage with the female piece.

For many applications it is desirable for a fastener to be flat and unobtrusive, with a low profile, particularly in those applications where appearance and safety are important.

Further, for many applications, and most dramatically in the safety applications, it is desirable for a fastener to be easily and quickly fastened, notwithstanding that the operator may be hurried or distracted, and at the same time be readily released when desired and resistant to stress that might cause accidental release. In view of the foregoing, it is advantageous to provide a buckle type fastener that successfully combines the features of low-profile, flatness, easy fastening and security against accidental release.

SUMMARY AND OBJECTS OF THE INVENTION

It is an object of the present invention to provide a low-profile, flat, two piece fastener, preferably in the form of a buckle, wherein a clasp piece is releasably engaged with a receptacle piece.

It is another object of the present invention to provide a two piece fastener, preferably in the form of a buckle, wherein the rigid tongue is releasably engaged to a cooperatively shaped receptable piece via a means for urging a first stop means and a second stop means into engagement.

It is a further object of the present invention to provide a two piece fastener, preferably in the form of a buckle, wherein the rigid tongue is releasably engaged to a cooperatively shaped receptacle piece via a means for urging comprising one or more protruding members integrally molded to the receptacle piece.

It is still another object of the present invention to provide a low-profile two piece fastener comprising a receptacle and a clasp; said clasp comprising a base having a substantially rigid tongue protruding therefrom, and a release tab on an upper surface of said rigid tongue, said release tab having a first shoulder comprising a first stop means; said receptacle comprising a body that defines a cavity adapted to receive said rigid tongue, an aperture in an upper panel of said receptacle, said aperture having a second shoulder comprising a second stop means disposed for cooperative engagement with said first stop means; means for urging said release tab into said aperture such that said first and second stop means abut one another and the clasp and receptacle are engaged; and means for releasing the engagement so that the receptacle and clasp may be separated.

It is another object of this invention to provide a means for disengaging the clasp and receptacle portions comprising applying pressure on a release tab located on the clasp portion so that the means for urging are compressed thereby separating the first shoulder from the second shoulder and allowing separation of the clasp and receptacle.

It is still another object of this invention to provide means for disengaging the clasp and receptacle portions comprising cocking the receptacle portion against the clamp portion so that the means for urging are compressed thereby separating the first shoulder from the second shoulder and allowing separation of the clasp and receptacle.

It is a still further object of the present invention that the means for urging the clasp and receptacle portions into engagement are located on the receptacle.

The invention provides a two piece fastener that comprises a clasp and a receptacle with means for urging the clasp and receptacle into engagement. The clasp comprises a base having a substantially rigid tongue protruding therefrom, a release tab on an upper surface of said rigid tongue, said release tab having a first shoulder comprising first stop means shaped to cooperatively engage a second stop means disposed on the receptacle. The receptacle comprises a body that defines a cavity adapted to receive the rigid tongue, an aperture in an upper panel of said receptacle, said aperture having a second shoulder comprising a second stop means disposed for cooperative engagement with said first stop means, and a means for urging said release tab into said aperture such that said first and second stop means abut one another and the receptacle and clasp are engaged. The fastener may also include means for disengaging the receptacle and clasp portions.

In a preferred embodiment: the receptacle is rectangular having two substantially parallel side panels, substantially parallel upper and lower panels and a back panel which define a cavity, and an aperture in the upper panel such that a second shoulder is formed which serves as a second stop means for abutting a first stop means; a frontal end and a distal end, and an opening into the cavity at the frontal end adapted to receive the clasp piece, means for urging the first and second shoulders into abutment so that the receptacle and clasp are engaged comprising at least one resilient arm mounted on the lower panel pushing upwardly on the rigid tongue so that a release tab on the upper surface of the rigid tongue enters the aperture on the upper panel, and at least one fixing arm on the back panel holding said second shoulder against said first shoulder; the clasp comprising a base and a rigid tongue having a release tab having a first shoulder thereon that serves as the first stop means; the rigid stem comprising a distal end with a support shoulder attached to the base and a leading edge opposite the distal end, the rigid stem extending substantially centrally from and normal to the base of the clasp, the leading edge having a groove shaped to cooperatively engage the means for urging.

In another embodiment the fastener has guide means for guiding the clasp into the cavity of the receptacle, and the receptacle and clasp include means for attaching a belt thereto.

In still another embodiment the opening forming the edge that is the second stop means is located on the bottom surface of the receptacle and the first stop means is located on the bottom of the rigid tongue such that when the clasp and receptacle are interlocked the first and second stop means are abutting.

In still another embodiment, the fastener is in the form of a buckle.

The fastener of the invention is a simple design and can be fastened quickly and easily; the symmetrical design prevents unbalanced forces that make fastening difficult so that the pieces are readily aligned and located with respect to each other. The pieces are also cooperatively shaped to provide an unobtrusive, low-profile and flat buckle once the pieces have been engaged. Furthermore, the fastener is remarkably secure.

As an added benefit, the means for separating the receptacle and clasp portions may be used by either one of two methods. The first method for separation comprises applying pressure on a release tab located on the clasp portion such that the means urging the two portions into engagement is compressed allowing the first stop means to clear the second stop means thereby allowing disengagement of the two portions. This first separation method is useful when the fastener is lying flat against a hard surface, such as a bare chest, etc.

The other method for separation comprises cocking the receptable portion against the clasp portion thereby causing the means for urging to compress and allowing the first stop means to clear the second stop mean. This second method for separation is particularly useful when the fastener is lying against a soft surface, such as a fluffy garment, or when the user cannot readily depress the release tab because he or she is wearing gloves or something else interferes with his or her ability to press the release tab.

Other objects and advantages of the invention will be apparent from the following detailed description of the preferred embodiments, and from the drawings.

DESCRIPTION OF THE PREFERRED EMBODIMENT

Figure 1:
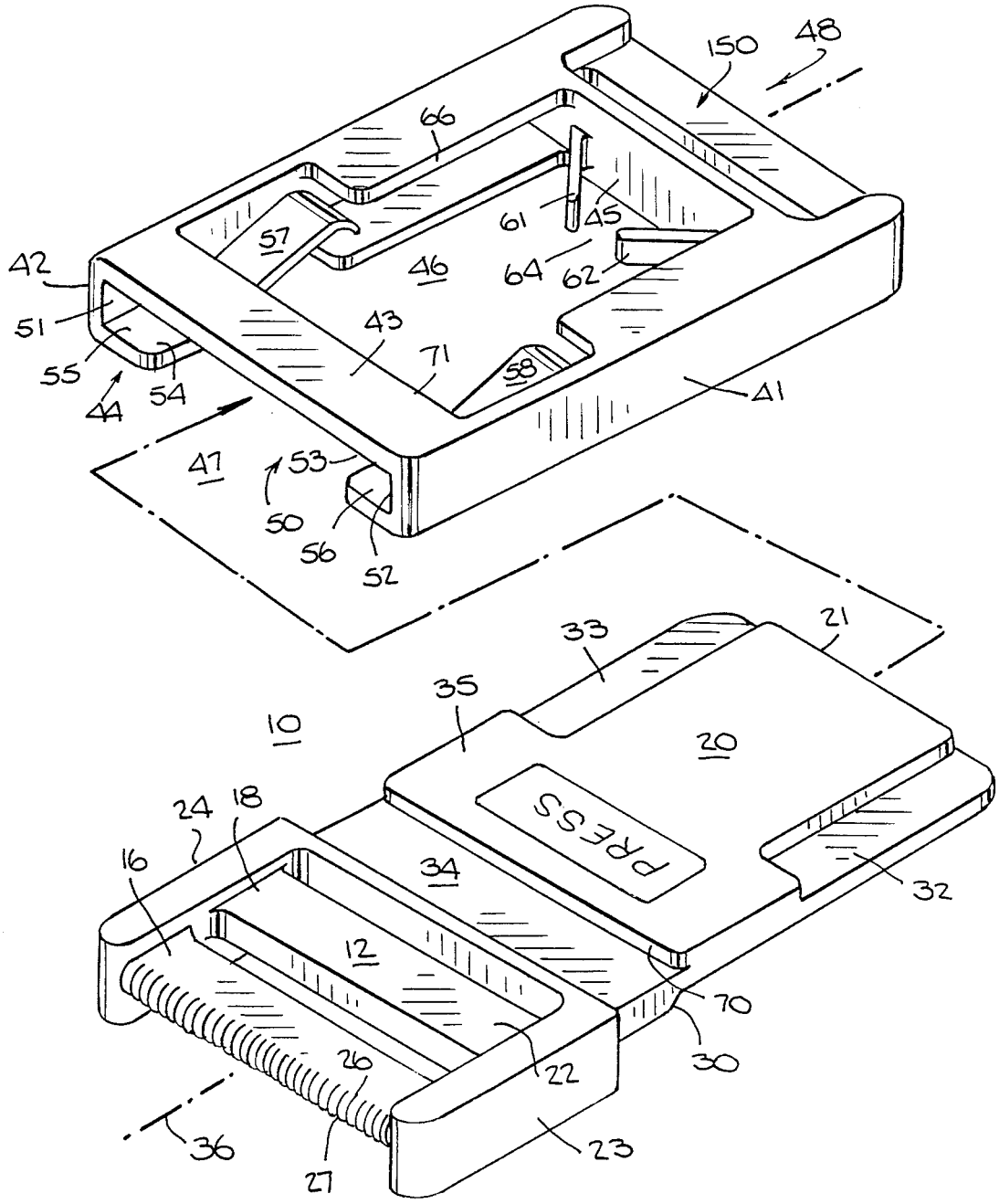
FIG. 1 is a perspective view of the fastener, showing the separate clasp and receptacle pieces, with the internal features of the receptacle piece shown in phantom.
Figure 2:
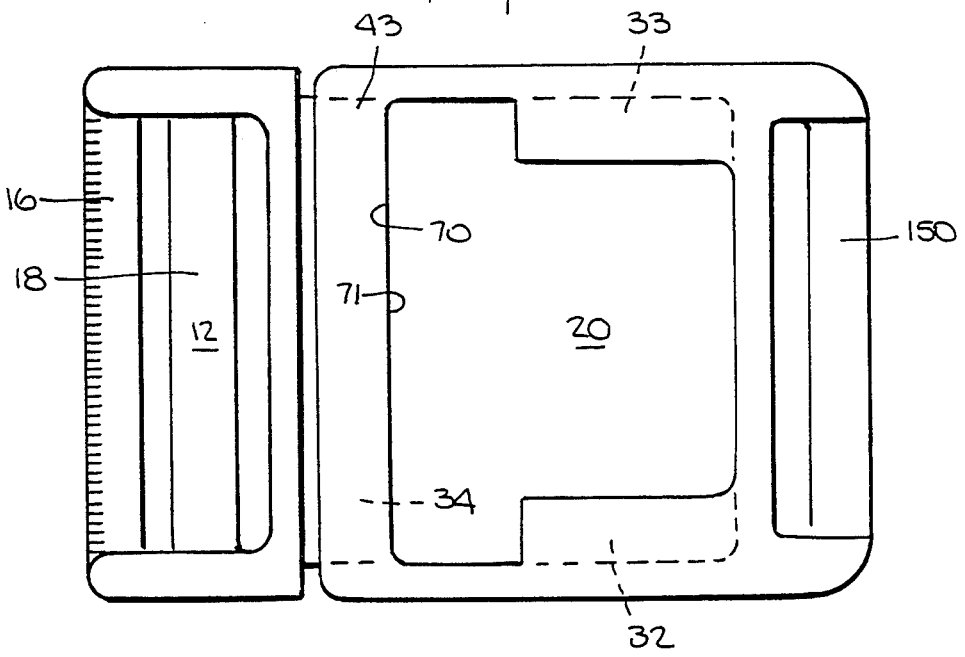
FIG. 2 is a perspective view of the fastener showing the clasp and fastened together, with the portion of the clasp piece that is within the receptacle shown in phantom.
Figure 3:
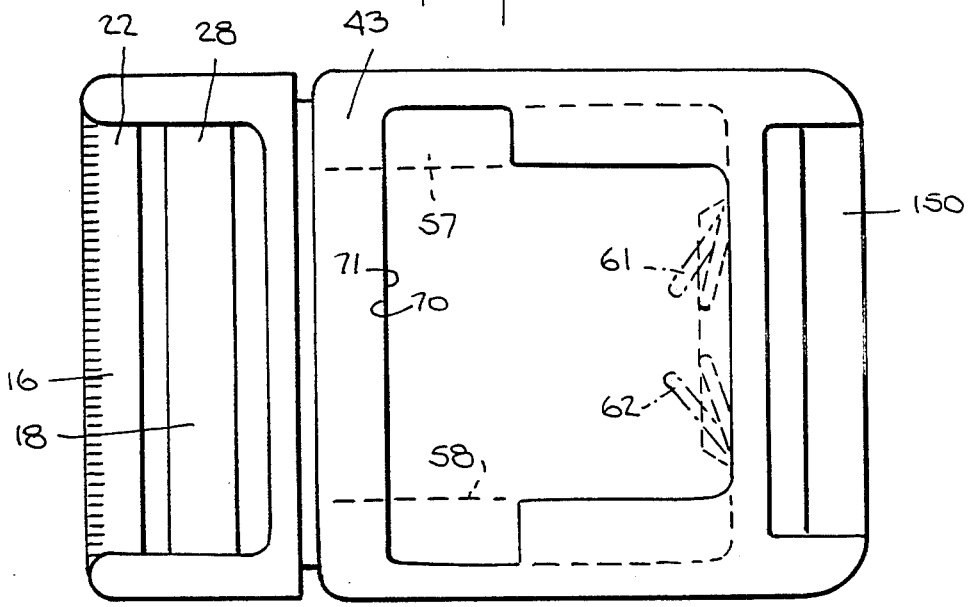
FIG. 3 is a top view of the clasp and receptacle including a cut away view of the receptacle piece and illustrating the range of movement of the resilient arms with phantom lines.
Figure 4:
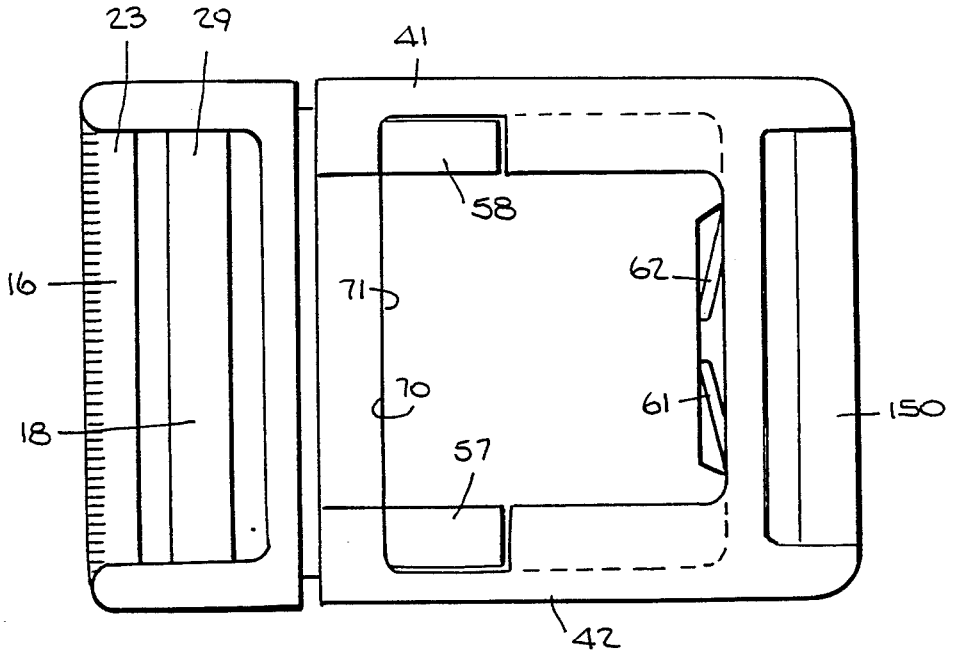
FIG. 4 is a bottom view showing clasp and receptacle pieces fastened together, including a cutaway view of the receptacle piece.
Figure 5:
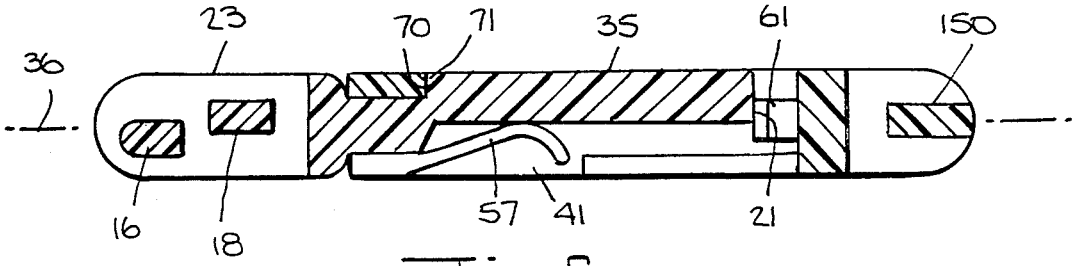
FIG. 5 is a cut away elevational view along the main central axis of the fastener.

Referring to FIG. 1, there is shown a fastener in the form of a buckle, generally identified by reference number 1, including a clasp piece 10 comprising a base portion 12 and a rigid tongue 20, and a receptacle piece 40.

The base portion 12 of clasp piece 10 comprises a base 24 and transverse bars 16 and 18. The bars are arranged to provide a means for adjustably fastening a belt or other web like material to the clasp piece. In cross section, bar 16 has generally a parallelogram shape. A top surface 22 and a bottom surface 23 of bar 16 are parallel to a main axis 36 of the clasp piece, while sides 23 and 24 of bar 16 are offset approximately 90°. The top surface 21 is provided with a plurality of transverse ridges 26, that can serve to hold a belt (not shown) fast to the clasp piece when the belt has been fed through bars 16 and 18, adjusted to the desired length, and pulled taut. Perpendicular teeth 27 prevent the belt from gathering or binding if the clasp is twisted about its main axis. Bar 18 in cross section has parallel top and bottom surfaces, 28 and 29, respectively, and has generally a rectangular shape. Of course, the size and shape of the web or strap holding portions can vary depending upon how the fastener is used and what it is to be connected to, if anything.

Rigid tongue 20 extends from the center of and normal to base portion 12 of clasp piece 10, along main axis 36 towards a leading edge 21. Rigid tongue 20 is integrally molded to base 12 forming a support shoulder 30 which is thicker than the rigid tongue thereby providing support to rigid tongue 20. Grooves 32 and 33 are disposed on an upper surface of rigid tongue 20 along axis 36 from midway from the base portion 12 to the leading edge 21. The shape of grooves 32 and 33 and a transverse groove 34 perpendicular to main axis 36 on rigid tongue 20 form a release tab 35 on rigid tongue 20 that is designed to engage with an aperture 66 on receptacle piece 40.

The receptacle piece 40 is generally rectangular in shape comprising substantially parallel side panels 41 and 42, substantially parallel upper 43 and lower 44 panels and a back panel 45 which define a cavity 46 with a frontal end 47 and a distal end 48 and a bar 150 at the distal end 48 adapted for fixedly attaching thereto a belt or web material (not shown). An opening 50 is located at frontal end 47 that opens into cavity 46 that is defined by substantially parallel inside surfaces 51 and 52 of side panels 41 and 42, respectively, substantially parallel upper 53 and lower 54 inside surfaces of top and bottom panels 43 and 44, respectively, and back panel 45 at distal end 48. Parallel upper 53 and lower 54 inside surfaces are perpendicular to parallel inside surfaces 51 and 52 and attached thereto, thereby forming channels 55 and 56. Extending approximately midway along lower inside surface 54 and upwards into cavity 46 are elongated resilient arms 57 and 58. These arms are mirror images of each other, essentially straight, and extend back from the frontal end 47 toward distal end 48. The angle included between either one of the resilient arms 57 and 58 and bottom inside surface 54 is about 30° although in application the angle may vary from about 5° to 90°. At the end of each resilient arm 57 and 58 are tabs 59 and 60, respectively. At distal end 48 extending from back inside surface 45 are fixing tabs 61 and 62, which are similarly shaped straight rigid arms extending outwardly into the cavity 46 from back panel 45 towards frontal end 47 at an approximately 45° angle, which angle in applicaiton may vary from about 5° to 90°. The placement of fixing tabs 61 and 62 provides a channel 64 so that the exit tabs may flex inwardly toward back panel 45 as the rigid tongue 20 is inserted. Upper panel 43 is provided with an aperture 66 which is shaped to lockingly engage with release tab 35 of clasp 10.

In operation, the rigid tongue 20 is inserted through opening 50 into the cavity 46 of receptacle piece 40. The arrangement of the channels 55 and 56, resilient arms 57 and 58 and fixing tabs 61 and 62 facilitates proper alignment of the pieces. Even if the receptacle and clasp pieces are initially not properly aligned, the channels and the interior arms of the receptacle will naturally correct any misalignment as the rigid tongue 20 is inserted. The grooves 32 and 33 of clasp 10 also facilitate proper alignment of the clasp as it is pushed along channels 55 and 56.

As rigid tongue 20 is inserted into cavity 46 of receptacle piece 40, channels 55 and 56 engage grooves 32 and 33, thus helping guide the clasp 10 into proper alignment with the receptacle 40. As the rigid tongue 20 is further inserted, resilient arms 57 and 58 urge rigid tongue 20 upwards until release tab 35 enters aperture 66. Simultaneously, leading edge 21 of rigid tongue 20 presses against fixing tabs 61 and 62 causing them to bend inwardly towards back panel 45 until channel 64 is substantially closed and they form with back panel 45 a substantially triangular shape. As the rigid tongue 20 is urged upward by the resilient arms 57 and 58, the fixing tabs 61 and 62 are simultaneously pressing against leading edge 31 to thereby urge a first stop means comprised of a first shoulder 70 on the release tab 35 into abutment with a second stop means comprised of a second shoulder 71 along the receptable channel 66 such that the clasp and receptacle cannot be pulled apart without separating said first shoulder 70 from said second shoulder 71. When the clasp and receptacle pieces are engaged, resilient arms 57 and 58 urge rigid tongue 20 upwardly forcing release tab 35 to fit snugly in aperture 66. Further, leading edge 21 of rigid tongue 20 is pressed against fixing tabs 61 and 62 helping to hold first shoulder 70 and second shoulder 71 together.

The engaging mechanism, comprising the resilient arms 57 and 58 and fixing tabs 61 and 62, provides an unusual degree of security to the buckle. Further, accidental disengagement is prevented by a support groove 19 resting on fixing tabs 61 and 62 which helps prevent the receptacle 40 and clasp 10 from twisting in relation to each other.

Although the engaging mechanism of the fastener can withstand substantial opening forces, it can be easily and conveniently released when desired. To release the fastener, the user simultaneously depresses resilient arms 57 and 58 by grasping and squeezing the release tab 35 of the clasp 10. As release tab 35 is pushed below upper surface 43, rigid tongue 20 is urged down resilient arms 57 and 58 which act as a ramp surface for rigid tongue 20. The positioning of fixing tabs 61 and 62 with the leading edge 21 of rigid tongue 20 assists disengagement of the fastener as fixing tabs 61 and 62 flex outwardly towards their original unflexed position, thereby pushing leading edge 21 and supplementing the pressure exerted by the user in separating the clasp and receptacle. Because release requires depression of release tab 35, the fastened buckle is unlikely to release accidently, particularly if the upper surface 33 of release tab 35 is parallel with upper surface 43.

The fastener may also be released by cocking the receptacle 40 in relation to the clasp 10 so that the resilient arms 57 and 58 are compressed and the first shoulder 70 is separated from second shoulder 71 thus allowing the fastener to be separated. This means for releasing the engagement of the receptable and clasp is particularly useful when the fastener is not placed flat against a hard surface such that pressing on the release tab 35 compresses the resilient arms 57 and 58 or if the user is wearing mittens or is otherwise unable to easily apply pressure on the release tab 35.

The buckle and clasp pieces of the invention are advantageously produced by integrally molding plastic.

USE

The buckle of the invention is extremely versatile and adapted to many uses in the leisure, camping, sports and safety markets. The buckle can be manufactured in a range of sizes, and the means for securing a belt or web like material to the clasp and receptacle pieces can be modified for specific uses. For example, the buckle of the invention can be used to secure the belts of a life jacket, backpack, or the like. The buckle can be used to secure shoulder straps or handles on luggage.

OTHER EMBODIMENTS

Other embodiments are within the following claims. For example, a buckle according to the invention could have only a single resilient arm. The angle included by the resilient arms can vary from the preferred angle of 30° , within the range of about 5° and about 90°. The angles of the engaging surfaces, relative to each other and relative to the main axis, can vary as well. Alternatively, the guide means can include a ridge extending the length of the base of the rigid arm and a cooperating groove in the receptacle piece. Alternatively, the guide means can be dispensed with entirely. Fasteners manufactured from plastics other than those enumerated above or from other material, e.g., metal, are considered within the scope of the invention.

What is claimed is:

1. A low-profile two piece plastic fastener comprising:

a receptacle and a clasp;

said clasp comprising a base having a substantially rigid tongue protruding therefrom, and a release tab on an upper surface of said rigid tongue, said release tab having a first shoulder comprising a first stop means;

said receptacle comprising a body that defines a cavity adapted to receive said rigid tongue, an aperture in an upper panel of said receptacle, said aperture having a second shoulder comprising a second stop means disposed for cooperative engagement with said first stop means;

means for urging said release tab into said aperture such that said first and second stop means abut one another and said receptacle and clasp are engaged;

said means for urging comprising at least one first protruding member within the cavity of the receptacle constructed and arranged to flex against the rigid tongue so as to urge the release tab into the aperture and at least one second protruding member within the cavity of the receptacle constructed and arranged to flex so as to urge the first shoulder against the second shoulder; and means for releasing the engagement so that the receptacle and clasp are separated.

2. The fastener of claim 1, wherein:

said receptacle is rectangular and comprises two substantially parallel side panels, substantially parallel upper and lower panels, a back panel and an opening into said cavity at a front end opposite said back panel; and said rigid tongue extends substantially centrally from and normal to said base.

3. The fastener of claim 1, wherein:

said first shoulder is formed by an edge of the release tab; and said second shoulder is formed by an edge of the aperture.

4. The fastener of claim 3, wherein said aperture is cooperatively shaped to engage said release tab.

5. The fastener of claim 1, wherein said means for releasing the engagement of the receptacle and clasp portions comprises:

said means for urging construded and arranged to flex inwardly as pressure is applied on the release tab so as to separate the first stop means from the second stop means, and to flex outwardly against the leading edge as the first and second stop means are separated so that the rigid tongue is pushed outwardly from the receptacle cavity.

6. The fastener of claim 1 wherein said clasp comprises:

a first guide means for engagement with the receptacle; and a second guide means within said receptacle cooperating with said first guide means.

7. The fastener of claim 6, wherein:

the elements of the first guide means comprise grooves and the elements of said second guide means comprise slots; and the grooves are adapted to slidingly engage said slots.

8. The fastener of claim 1, wherein the receptacle and clasp each includes means for attaching a belt or the like thereto, at least one of the attaching means including means for selectively adjusting the length of said belt.

9. A low-profile two piece plastic fastener comprising:

a receptacle and a clasp;

said receptacle being rectangular and comprising two substantially parallel side panels, substantially parallel upper and lower panels, a back panel and an opening into said cavity at a front end opposite said back panel;

said clasp comprising a base having a substantially rigid tongue protruding therefrom, said rigid tongue extending substantially centrally from and normal to said base, and a release tab on an upper surface of said rigid tongue, said release tab having a first shoulder formed by an edge of said release tab comprising a first stop means;

said receptacle comprising a body that defines a cavity adapted to receive said rigid tongue, an aperture in an upper panel of said receptacle cooperatively shaped to engage said release tab, said aperture having a second shoulder formed by an edge of said aperture comprising a second stop means disposed for cooperative engagement with said first stop means;

means for urging said release tab into said aperture such that said first and second stop means abut one another and said receptacle and clasp are engaged;

said means for urging comprising at least one first protruding member within the cavity of the receptacle constructed and arranged to flex against the rigid tongue so as to urge the release tab into the aperture and at least one second protruding member within the cavity of the receptacle constructed and arranged to flex so as to urge the first shoulder against the second shoulder; and means for releasing the engagement so that the receptacle and the clasp are separated.

10. The fastener of claim 9, wherein:

the first protruding member comprises at least one resilient arm extending upwardly into the cavity; and the second protruding member comprises at least one fixing tab extending outwardly into the cavity.

11. The fastener of claim 10, wherein:

the included angle between the lower panel and the resilient arms is from 5 to 90 degrees, and preferably about 30 degrees; and the included angle between the back panel and the fixing tabs is from 5 to 90 degrees, and preferably about 45 degrees.

12. A low-profile two piece plastic buckle comprising:

a receptacle and a clasp;

said clasp comprising a base having a substantially rigid tongue protruding therefrom, and a release tab on an upper surface of said rigid tongue, said release tab having a first shoulder comprising a first stop means;

said receptacle comprising a body that defines a cavity adapted to receive said rigid tongue, an aperture in an upper panel of said receptacle, said aperture having a second shoulder comprising a second stop means disposed for cooperative engagement with said first stop means;

means for urging said release tab into said aperture such that said first and second means abut one another and said receptacle and clasp are engaged;

said means for urging comprising at least one first protruding member within the cavity of the receptacle constructed and arranged to flex against the rigid tongue so as to urge the release tab into the aperture and at least one second protruding member within the cavity of the receptacle constructed and arranged to flex so as to urge the first shoulder against the second shoulder; and means for releasing the engagement so that the receptacle and clasp are separated.

13. The buckle of claim 12, wherein:

said receptacle is rectangular and comprises two substantially parallel side panels, substantially parallel upper and lower panels, a back panel and an opening into said cavity at a front end opposite said back panel; and said rigid tongue extends substantially centrally from and normal to said base.

14. The buckle of claim 13, wherein:

said first shoulder is formed by a first edge of the release tab; and said second shoulder is formed by a second edge of the aperture.

15. The buckle of claim 14, wherein said aperture is cooperatively shaped to engage said release tab.

16. The buckle of claim 12, wherein said means for releasing the engagement comprises:

said means for urging constructed and arranged to flex inwardly as pressure is applied on the release tab so as to separate the first stop means from the second stop means, and to flex outwardly against the leading edge as the first and second stop means are separated so that the rigid tongue is pushed outwardly from the receptacle cavity.

17. The buckle of claim 12 wherein said clasp comprises:

a first guide means for engagement with the receptacle; and a second guide means within said receptacle cooperating with said first guide means.

18. The buckle of claim 17, wherein:

the elements of the first guide means comprise grooves and the elements of said second guide means comprise slots; and said grooves are adapted to slidingly engage said slots.

19. The buckle of claim 12, wherein the receptacle and clasp each includes means for attaching a belt or the like thereto, at least one of the attaching means including means for selectively adjusting the length of said belt.

20. A low-profile two piece plastic fastener comprising:

a receptacle and a clasp;

said receptacle being rectangular and comprising two substantially parallel side panels, substantially parallel upper and lower panels, a back panel and an opening into said cavity at a front end opposite said back panel;

said clasp comprising a base having a substantially rigid tongue protruding therefrom, said rigid tongue extending substantially centrally from and normal to said base, and a release tab on an upper surface of said rigid tongue, said release tab having a first shoulder formed by an edge of said release tab comprising a first stop means;

said receptacle comprising a body that defines a cavity adapted to receive said rigid tongue, an aperture in an upper panel of said receptacle cooperatively shaped to engage said release tab, said aperture having a second shoulder formed by an edge of said aperture comprising a second stop means disposed for cooperative engagement with said first stop means;

means for urging said release tab into said aperture such that said first and second stop means abut one another and said receptacle and clasp are engaged;

said means for urging comprising at least one first protruding member within the cavity of the receptacle constructed and arranged to flex against the rigid tongue so as to urge the release tab into the aperture and at least one second protruding member within the cavity of the receptacle constructed and arranged to flex so as to urge the first shoulder against the second shoulder; and means for releasing the engagement so that the receptacle and the clasp are separated.

21. The buckle of claim 20, wherein:

the first protruding member comprises at least one resilient arm extending upwardly into the cavity; and the second protruding member comprises at least one fixing tab extending outwardly into the cavity.

22. The buckle of claim 21, wherein:

the included angle between the lower panel and the resilient arms is from 5 to 90 degrees, and preferably about 30 degrees; and the included angle between the back panel and the fixing tabs is from 5 to 90 degrees, and preferably about 45 degrees.

* * * * *

UNITED STATES PATENT AND TRADEMARK OFFICE

CERTIFICATE OF CORRECTION

PATENT NO. : 4,949,436

DATED : Aug. 21, 1990

INVENTOR(S) : Joseph A. Anscher

It is certified that error appears in the above-identified patent and that said Letters Patent is hereby corrected as shown below:

Col. 3, line 45, add the letter --s-- after the word "mean".

Col. 3, line 61, delete "perspective" and insert --top--.

Col. 7, line 25, delete "construded" and insert --construed--.

Signed and Sealed this

Tenth Day of March, 1992

*Attest:*

HARRY F. MANBECK, JR.

*Attesting Officer*

*Commissioner of Patents and Trademarks*